US006499204B2

(12) United States Patent
Hayashi

(10) Patent No.: US 6,499,204 B2
(45) Date of Patent: Dec. 31, 2002

(54) DEVICE FOR PRESS-FITTING CATALYZER CORE BED INTO OUTER CASE

(75) Inventor: Tetsuji Hayashi, Kanagawa (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/870,740

(22) Filed: Jun. 1, 2001

(65) Prior Publication Data

US 2001/0048904 A1 Dec. 6, 2001

(30) Foreign Application Priority Data

Jun. 1, 2000 (JP) ..... 2000-164439

(51) Int. Cl.[7] ..... B23P 19/04
(52) U.S. Cl. ..... 29/252
(58) Field of Search ..... 29/263, 252, 280, 29/272, 282, 255

(56) References Cited

U.S. PATENT DOCUMENTS

| | | | | |
|---|---|---|---|---|
| 3,762,021 A | * | 10/1973 | Racin | 29/263 |
| 4,847,966 A | | 7/1989 | Kuchelmeister | |
| 5,701,649 A | * | 12/1997 | Ressor et al. | 29/252 |

FOREIGN PATENT DOCUMENTS

| | | |
|---|---|---|
| DE | 3634235 | 8/1986 |
| DE | 19753609 | 3/1997 |
| JP | 8-164487 | 6/1996 |

* cited by examiner

*Primary Examiner*—Joseph J. Hail, III
*Assistant Examiner*—Lee Wilson
(74) *Attorney, Agent, or Firm*—Foley & Lardner

(57) ABSTRACT

In order to properly press-fit or thrust a cylindrical coiled body into a cylindrical case, a fitting device is provided. The fitting device comprises a guide member formed with a conical bore of which cross section gradually reduces with increase of a distance from a top of the bore toward a bottom of the same. The cross section of the bottom of the bore is slightly smaller than that of the coiled body. The guide member is coaxially put on the cylindrical case. The fitting device further comprises a pressing member which, when actuated, presses down the cylindrical coiled body raised in the bore thereby to thrust the raised coiled body into the cylindrical case through the bottom of the bore. The pressing member includes a center base plate, two side plates positioned on both sides of the center base plate, a guide structure by which the side plates are radially movable in opposite directions with respect to the center base plate, and biasing members for biasing the side plates radially outward.

14 Claims, 7 Drawing Sheets

DEVICE FOR PRESS-FITTING CATALYZER CORE BED INTO OUTER CASE

BACKGROUND OF THE INVENTION

1. Field of the Invention

The present invention relates in general to devices for assembling catalytic converters, and more particularly to devices for press-fitting a cylindrical catalyzer core bed (or coiled body) into a cylindrical metal case.

2. Description of the Related Art

In order to clarify the task of the present invention, a known technique for press-fitting a cylindrical catalyzer core bed into a cylindrical outer case will be briefly described with reference to FIGS. 13 to 15 of the accompanying drawings. This technique is described in Japanese Patent First Provisional Publication 8-164487.

FIG. 13 shows a method for producing a cylindrical catalyzer core bed (or coiled body) 5 that is a bed for catalyzer. As shown, a flat metal plate 3 and a corrugated metal plate 1 are put on one another and these overlapped plates 3 and 1 are coiled together to form a coiled body 5 which has a circular cross section as shown. After having a brazing foil of Ni (nickel) put around an axially rear end, the coiled body 5 is press-fitted into a cylindrical metal case 7 (see FIGS. 14A and 14B), and then this unit consisting of the coiled body 5 and the metal 7 is led into a vacuum furnace to be subjected to a heat treatment. With this, the flat and corrugated metal plates 3 and 1 are diffusion-bonded and at the same time the coiled body 5 and the cylindrical metal case 7 are brazed.

FIGS. 14A and 14B show a fitting device 13 for press-fitting the coiled body 5 into the cylindrical metal case 7. As shown, the fitting device 13 generally comprises a guide member 9 and a circular pressing member 11. The guide member 9 is formed with a conical bore 9*a*, and the pressing member 11 is powered by a hydraulic actuator (not shown). The diameter "A" of the largest upper end of the conical bore 9*a* is larger than the outer diameter "B" of the coiled body 5, and the diameter "C" of the smallest lower end of the conical bore 9*a* is equal to or slightly smaller than the inner diameter "D" of the metal case 7. Of course, the diameter "A" is larger than the diameter "C". The pressing member 11 is sized somewhat smaller than the smallest lower end "C" of the conical bore 9*a* and has a flat lower surface.

For carrying out the press-fitting, at first, as is shown in FIG. 14A, the guide member 9 is correctly set on one open end of the metal case 7, and the coiled body 5 is raised and coaxially put into the conical bore 9*a* of the guide member 9 from the largest upper end of the bore 9*a*. Then, the pressing member 11 is put on a flat end face 5*a* of the coiled body 5 and pushed downward by a length of "L" by the force of the hydraulic actuator. With this pushing action, the coiled body 5 is thrust into the metal case 7, as is seen from FIG. 14B. Under passing through the smallest lower end of the conical bore 9*a*, the coiled body 5 is subjected to a certain shrinkage in diameter, which smoothes the insertion of the coiled body 5 into the metal case 7. After reaching a proper position in the metal case 7, the coiled body 5 is somewhat expanded resiliently due to a restoring force thereof, and thus the cylindrical outer surface of the coiled body 5 entirely contacts the cylindrical inner surface of the metal case 7. The unit thus assembled, namely, the assembled unit consisting of the coiled body 5 and the metal case 7, is then put into a vacuum furnace for the heat treatment.

SUMMARY OF THE INVENTION

However, the above-mentioned known technique has failed to provide the users with satisfied results for the following reasons. That is, as is understood from FIG. 15, when the coiled body 5 is pressed down in the conical bore 9*a* by the pressing member 11, a circumferential portion of the flat end face 5*a* of the body 5 is unsightly slid off from the major part of the flat end face 5*a* due to appearance of an annular dead zone "S" between the periphery 11*a* of the pressing member 11 and the sloped inner wall 9*b* of the conical bore 9*a*, which has no pressure applied thereto from the pressing member 11. In fact, during thrusting of the coiled body 5 in the conical bore 9*a*, the slid-off portion of the end face 5*a* is severely pressed between the pressing member 11 and the sloped inner wall 9*b* and thus squashed unsightly, which lowers not only performance of the product but also external appearance of the same.

It is therefore an object of the present invention to provide a device for press-fitting a coiled body into a cylindrical metal case, which is free of the above-mentioned shortcomings.

According to a first aspect of the present invention, there is provided a device for press-fitting a generally cylindrical body into a cylindrical case, the generally cylindrical body being subjected to reduction in diameter when applied with a certain external force from a radial direction. The device comprises a guide member formed with a vertically extending bore of which cross section gradually reduces in size with increase of a distance from a top of the bore toward a bottom of the same, the cross section of the bottom of the bore being slightly smaller than that of the generally cylindrical body, the guide member being adapted to be put on the cylindrical case having the bore of the guide member coaxially aligned with the interior of the cylindrical case; a pressing member which, when actuated, presses down the generally cylindrical body raised in the bore of the guide member thereby to thrust the raised generally cylindrical body into the cylindrical case through the bottom of the bore; and an actuator for actuating the pressing member, wherein the member includes a center base plate, at least two side plates positioned on both sides of the center base plate, a guide structure by which the side plates are radially movable in opposite directions with respect to the center base plate, and biasing members for biasing the side plates radially outward.

According to a second aspect of the present invention, there is provided a device for press-fitting a cylindrical coiled body into a cylindrical case, which comprises a guide member formed with a conical bore of which cross section gradually reduces in size with increase of a distance from a top of the bore toward a bottom of the same, the cross section of the bottom of the bore being slightly smaller than that of the coiled body, the guide member being adapted to be put on the cylindrical case having the bore of the guide member coaxially aligned with the interior of the cylindrical case; a pressing member which, when actuated, presses down the cylindrical coiled body raised in the bore of the guide member thereby to thrust the raised coiled body into the cylindrical case through the bottom of the bore; and an actuator for actuating the pressing member, wherein the pressing member includes a circular center base plate; two arcuate side plates positioned at both sides of the center base plate having concave sides thereof directed toward the base plate; a stay bolt held by the center base plate and having axially opposed end portions projected from the center base plate in opposite directions, the axially opposed end portions movably carrying the arcuate side plates; and two spring members each being compressed between the center base plate and corresponding one of the arcuate side plates to bias the arcuate side plate outward.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

Figure 1:
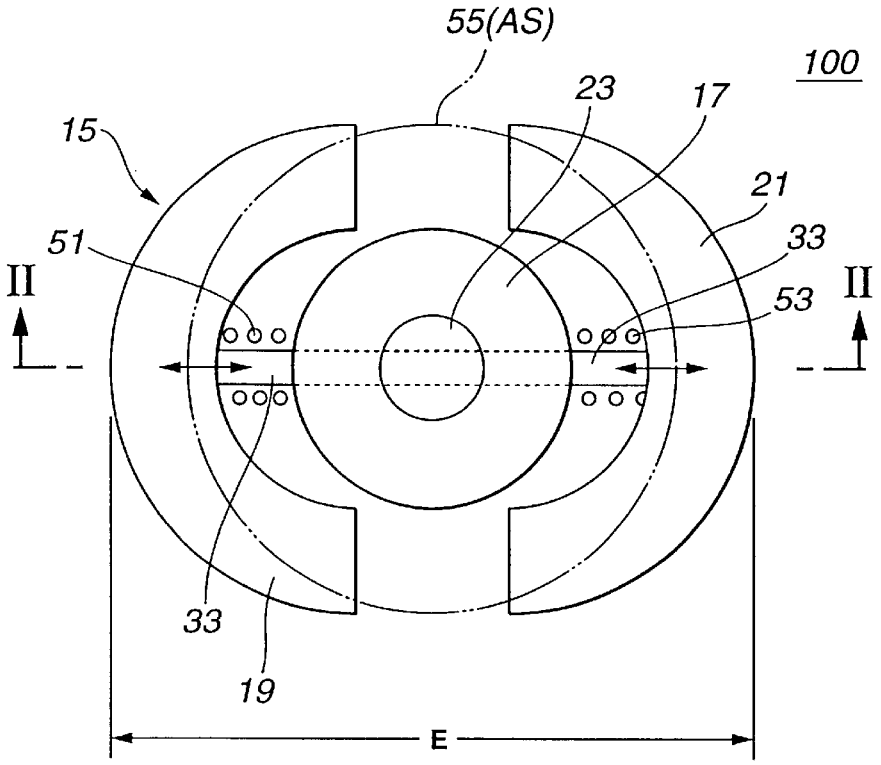
FIG. 1 is a plan view of a pressing member used in a fitting device of a first embodiment of the present invention.

In the following, various embodiments of the present invention will be described with reference to the accompanying drawings. For ease of understanding, directional terms, such as, right, left, upper, lower, rightward, etc., will be used in the following description. However, such terms are to be understood with respect to only a drawing or drawings in which the corresponding member or portion is shown. Throughout the specification, similar or substantially same parts and elements are denoted by the same reference numerals.

Referring to FIGS. 1 to 4, there is shown a fitting device 100 which is a first embodiment of the present invention.

Figure 3:
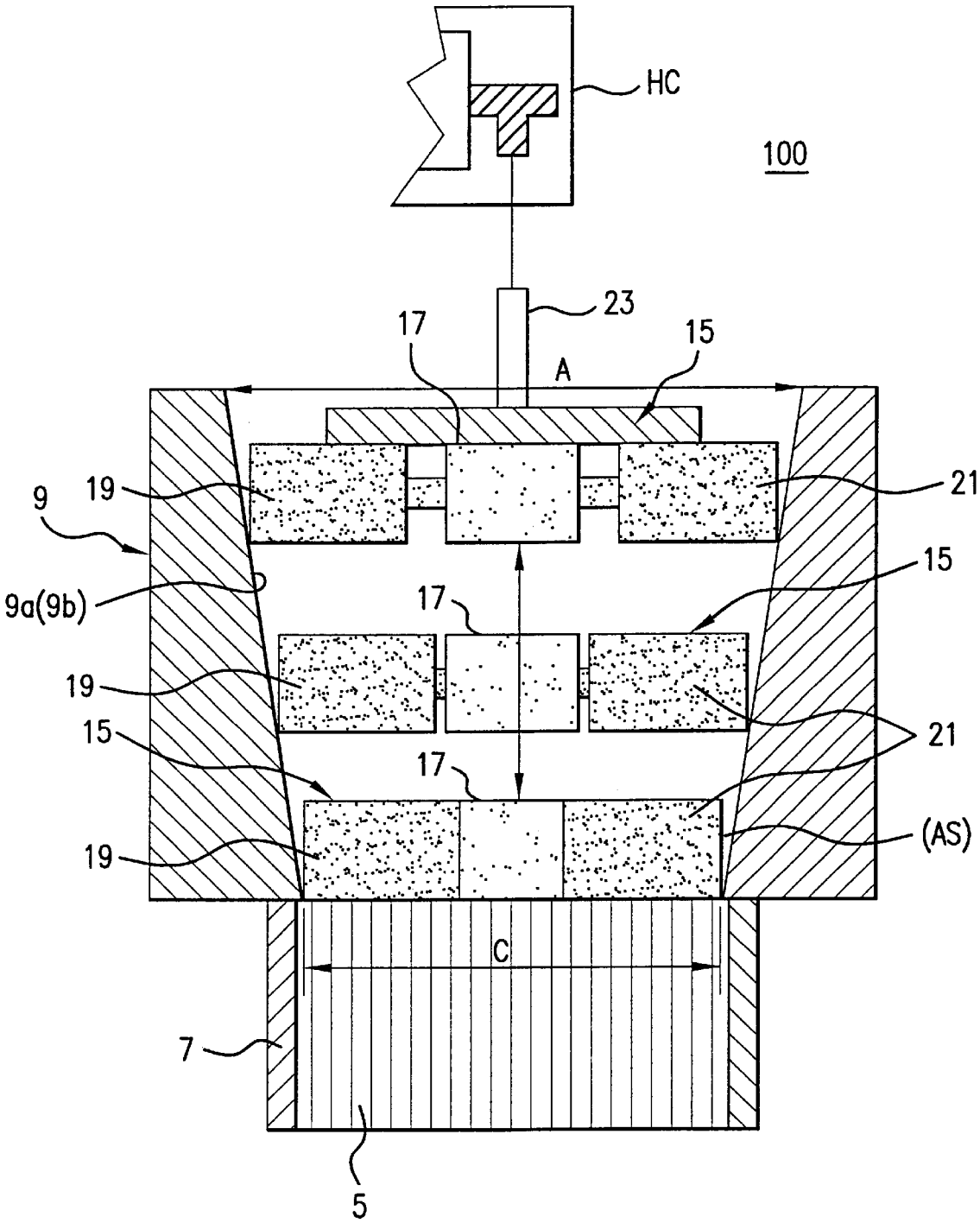
FIG. 3 is a sectional view of the fitting device of the first embodiment, schematically showing various conditions of the pressing member with respect to a guide member.

As is seen from FIG. 3, the fitting device 100 of this embodiment generally comprises a guide member 9 and a pressing member 15. It is to be noted that FIG. 3 shows three conditions or positions of the pressing member 15 in the guide member 9.

Figure 14A:
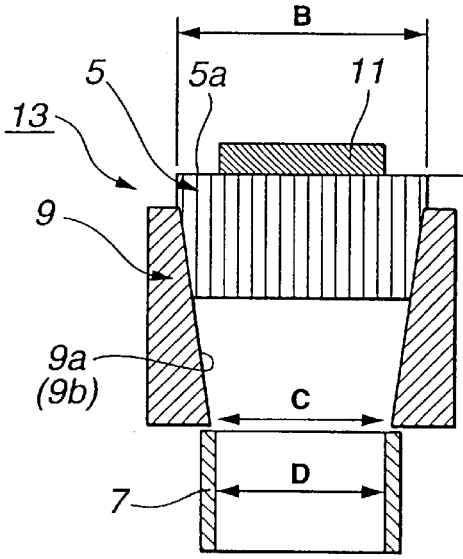
FIGS. 14A and 14B are sectional views of a known fitting device, showing two different conditions respectively.
Figure 14B:
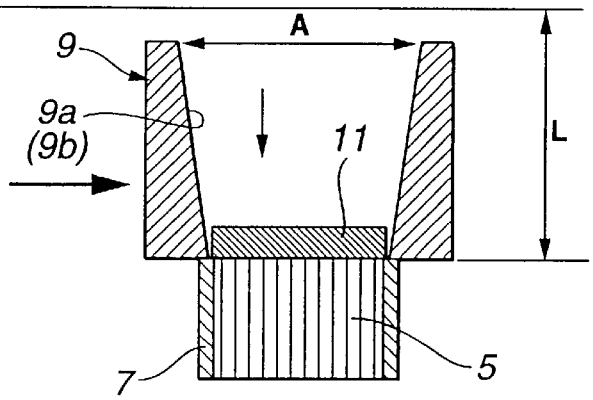

As is seen from FIG. 3, the guide member 9 is formed with a conical bore 9*a*, which is substantially the same as the above-mentioned known guide member 9 shown in FIGS. 14A and 14B. That is, the diameter "A" of the largest upper end of the bore 9*a* is larger than the diameter "C" of the smallest lower end of the bore 9*a*.

Figure 2:
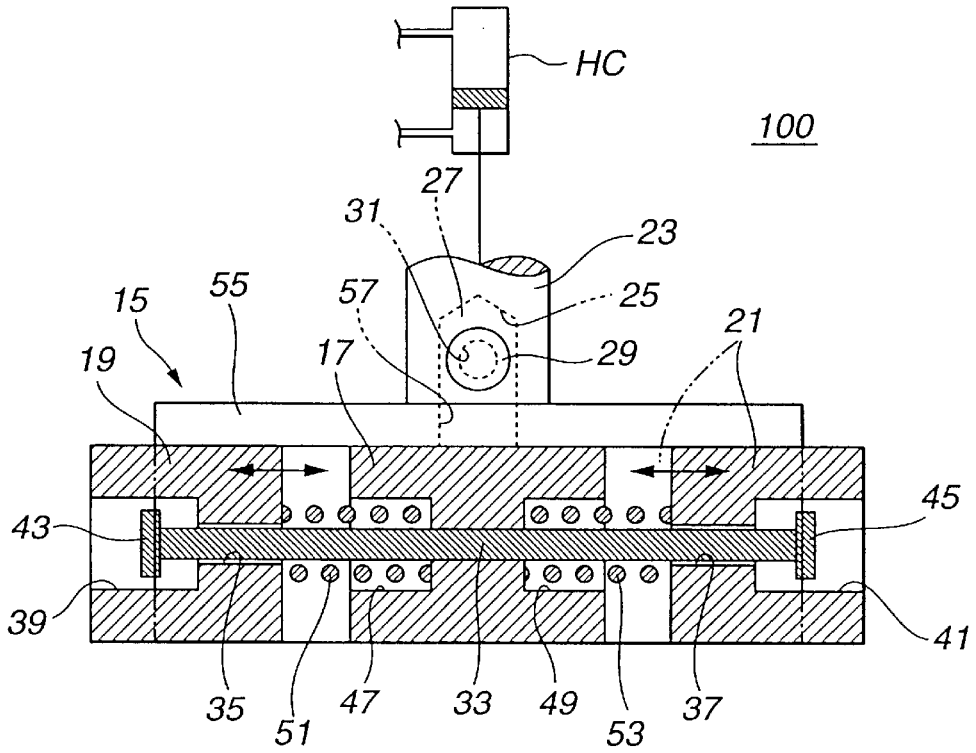
FIG. 2 is a sectional view taken along the line II—II of FIG. 1.

As is seen from FIGS. 1 and 2, the pressing member 15 comprises generally a circular center base plate 17, two arcuate side plates 19 and 21 arranged at diametrically opposed positions of the center base plate 17, a stay bolt 33 passing diametrically through the center base plate 17 to loosely hold the side plates 19 and 21 on its axially opposed exposed portions, and two coil springs 51 and 53 for biasing the side plates 19 and 21 radially outward from the center base plate 17.

As is seen from FIG. 1, each of the side plates 19 and 21 has in an inside part thereof a concave recess whose perimeter is substantially the same as that of a half of the center base plate 17. Thus, when the two side plates 19 and 21 move toward each other and finally come to their innermost positions, they form an annular structure "AS" intimately surrounding the circular center base plate 17.

As is seen from FIG. 3, the diameter of the annular structure "AS" is slightly smaller than the diameter "C" of the smallest lower end of the conical bore 9*a*.

As is seen from FIG. 2, the circular center base plate 17 and the two arcuate side plates 19 and 21 have the same thickness and upper and lower flat surfaces which are flush with one another. The circular center base plate 17 is provided at a center portion thereof with an mounting rod 27 which projects upward. The mounting rod 27 is received in a mounting bore 25 formed in a lower end of a piston rod 23 of a hydraulic cylinder "HC". For connecting the mounting rod 27 to the piston rod 23, a connecting pin 29 is used, which passes through aligned holes 31 formed in the mounting rod 27 and the piston rod 23.

As is seen from FIGS. 1 and 2, the stay bolt 33 diametrically passes through the circular center base plate 17 to be tightly held by the same having axially opposed end portions thereof projected from the center base plate 17. The opposed end portions of the stay bolt 33 pass loosely through bores 35 and 37 respectively formed in the arcuate side plates 19 and 21. Thus, the two arcuate side plates 19 and 21 can slide along the stay bolt 33 relative to the circular center base plate 17, as is indicated by the arrows. As shown, each end of the stay bolt 33 is provided with an enlarged stopper 43 or 45 which is exposed to a recess 39 or 41 formed in the side plate 19 or 21. Due to provision of the stopper 43 or 45, unwilled separation of the side plate 19 or 21 from the stay bolt 33 is suppressed.

As shown in FIG. 2, between the circular center base plate 17 and each of the side plates 19 and 21, there is compressed the coil spring 51 or 53. Thus, the side plates 19 and 21 are biased radially outward. For receiving inside ends of the coils springs 51 and 53, the circular center base plate 17 is formed at diametrically opposed portions respective recesses 47 and 49. Due to work of the coil springs 51 and 53, the side plates 19 and 21 assume their outermost positions in a normal state of the pressing member 15. In this condition, the length "E" (see FIG. 1) of the major axis of the pressing member 15 is equal to or slightly smaller than the diameter "A" (see FIG. 3) of the largest upper end of the conical bore 9*a* of the guide member 9.

As is seen from FIG. 2, between the lower end of the piston rod 23 and the upper surface of the circular center base plate 17, there is disposed a circular guide plate 55 which is secured to the center base plate 17. The guide plate 55 has a flat lower surface intimately and slidably contacting with the upper flat surface of the side plates 19 and 21. Denoted by numeral 57 is an opening through which the mounting rod 27 of the center base plate 17 projects upward toward the mounting bore 25 of the piston rod 23.

Preferably, as is seen from FIG. 1, the circular guide plate 55 has the same diameter of the above-mentioned annular structure "AS" which is provided when the two side plates 19 and 21 take their innermost positions. More specifically, the diameter of the circular guide plate 55 is slightly smaller than the diameter "C" of the smallest end of the conical bore 9*a* of the guide member 9. As will be described hereinafter, due to provision of the guide plate 55, undesired inclination of the two side plates 19 and 21, which would occur during thrusting of the pressing member 15 into the conical bore 9*a* of the guide member 9, is suppressed.

In the following, steps for press-fitting the coiled body 5 into the cylindrical metal case 7 by using the fitting device 100 of the first embodiment will be described with the aid of FIGS. 1, 2 and 3. The coiled body 5 has a brazing foil of Ni (nickel) put around an axially rear end thereof.

First, as is seen from FIG. 3, the guide member 9 is properly set on one open end of the cylindrical metal case 7, and the coiled body 5 is raised and coaxially put into the conical bore 9*a* of the guide member 9 from the largest upper open end of the bore 9*a*, like in the case of the above-mentioned known technique as shown in FIG. 14A. Then, with energization of the hydraulic cylinder "HC", the pressing member 15 is brought onto the flat end face 5*a* of the coiled body 5 and pushed down by a given length. With this, the coiled body 5 is thrust into the cylindrical metal case 7, like in the case of the above-mentioned known technique of FIGS. 14A and 14B. Under passing through the smallest lower end of the conical bore 9*a*, the boiled body 5 is subjected to a certain shrinkage in diameter, which smoothes the insertion of the coiled body into the metal case 7. After reaching a proper position in the metal case 7, the coiled body 5 is somewhat expanded resiliently due to the restoring force thereof, and thus the cylindrical outer surface of the coiled body 5 entirely contacts the cylindrical inner surface of the metal case 7.

During the above-mentioned downward movement of the pressing member 15 in the guide member 9, the following unique and advantageous behavior is carried out by the pressing member 15.

Figure 15:
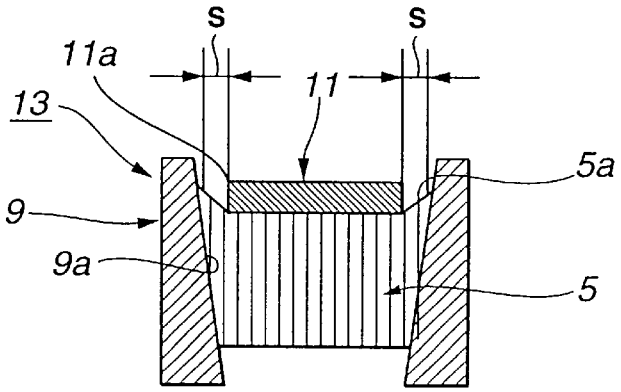
FIG. 15 is a sectional view of the known fitting device, showing a shortcoming possessed by the known fitting device.

That is, as is seen from FIG. 3, during downward movement of the pressing member 15 in the conical bore 9*a*, the two arcuate side plates 19 and 21 slidably contacting the sloped inner wall 9*b* of the bore 9*a* are forced to move radially inward against the springs 51 and 53 gradually reducing the actual size of the pressing member 15. That is, during the downward movement of the pressing member 15 to thrust down the coiled body 5, the convex outer walls of the two side plates 19 and 21 of the pressing member 15 constantly contact the sloped inner wall 9*b* of the bore 9*a*. This means that, in the first embodiment, undesired dead zone, such as the annular dead zone "S" appearing in the above-mentioned known technique (see FIG. 15), is not produced. That is, during the thrusting, the flat upper end face 5*a* of the coiled body 5 is substantially entirely pressed by the pressing member 15, and thus, the entire construction of the coiled body 5 is evenly pressed by the pressing member 15 without producing an unsightly slid off part of the body 5. Once the thrusting is finished, the pressing member 15 is lifted up by operating the hydraulic cylinder in an opposite direction. During this upward movement of the pressing member 15, the two side plates 19 and 21 are moved radially outward due to the biasing force of the coil springs 51 and 53 gradually increasing the actual size of the pressing member 15. Thus, when the pressing member 15 is drawn out from the bore 9*a*, the same takes a largest original size as shown in FIG. 1.

Figure 4:
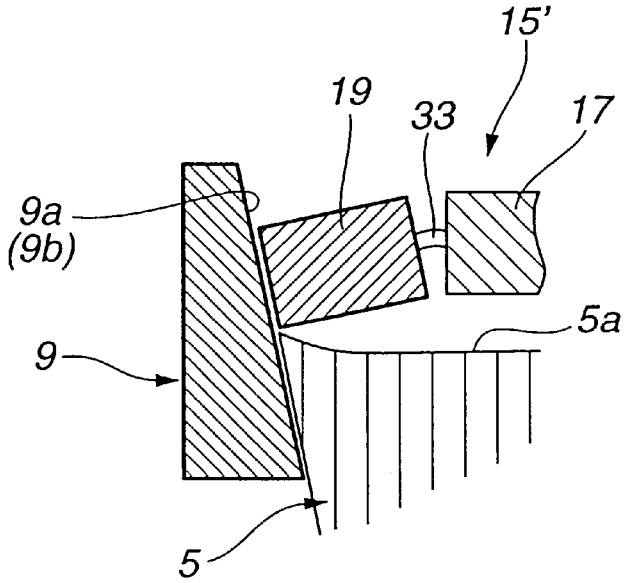
FIG. 4 is a sectional view of a part of the fitting device, schematically showing an undesirable behavior of the pressing member, which would occur if a guide plate is not provided.

Due to provision of the circular guide plate 55, the radial movement of the two side plates 19 and 21 is smoothly, straightly and stably made. If such guide plate 55 is not provided, slight but certain inclination of the side plates 19 and 21 may occur as is shown in FIG. 4, which would be caused by intimate contact between the outer surface of the side plates 19 and 21 and the sloped inner wall 9*a* of the guide member 9.

The unit thus assembled, that is, the assembled unit consisting of the coiled body 5 and the metal case 7, is then put into a vacuum furnace for the heat treatment. With this, the flat and corrugated metal plates 3 and 1 are diffusion-bonded and at the same time, the coiled body 5 and the cylindrical metal case 7 are brazed. That is, a honeycomb type catalyzer bed (or carrier) is produced.

As is described hereinabove, in the first embodiment 100 of the invention, the actual size of the pressing member 15 is varied in accordance with the bore diameter of the position where the pressing member 15 is located. In other words, the two side plates 19 and 21 are radially moved in accordance with such bore diameter while contacting with the sloped inner wall 9*a* of the guide member 9. Thus, the coiled body 5 is prevented from forming an undesired slid-off portion therearound.

Figure 5:
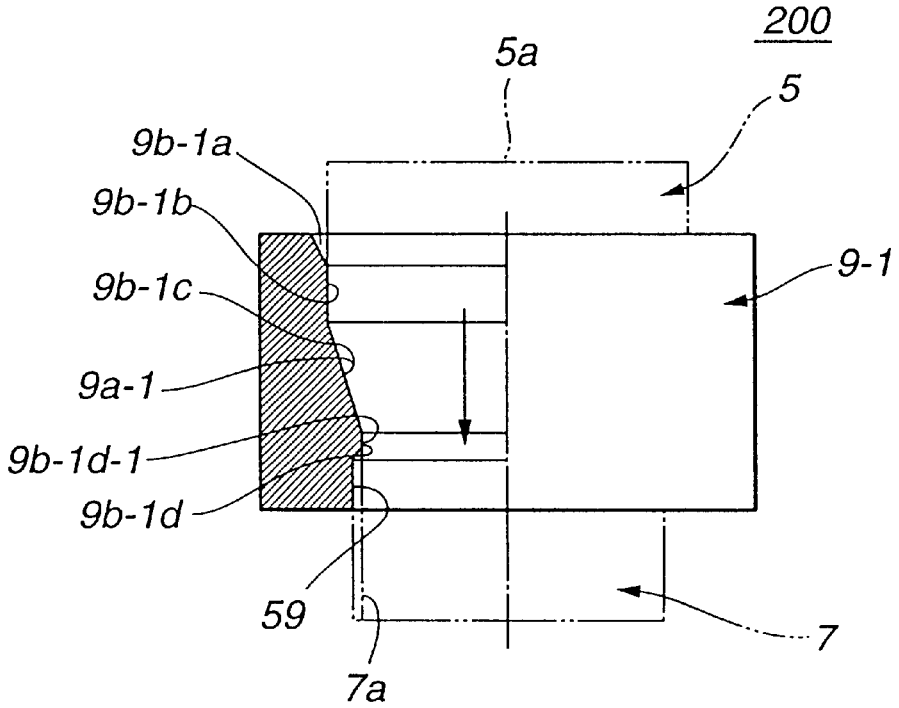
FIG. 5 is a sectional view of a guide member which is used in a fitting device of a second embodiment of the present invention.

Referring to FIG. 5, there is shown a guide member 9-1 which is used in a fitting device 200 of a second embodiment of the present invention. In this second embodiment, the pressing member is the same as the pressing member 15 used in the first embodiment 100.

As is shown, the guide member 9-1 used in this second embodiment 200 is formed with a generally conical bore 9*a*-1 which comprises a plurality of coaxial circular sections, which are a tapered upper section 9*b*-1*a* which has the largest diameter, a first cylindrical section 9*b*-1*b* which extends downward from the tapered upper section 9*b*-1*a* and has a diameter equal to or slightly larger than the diameter of the coiled body 5, a conical section 9*b*-1*c* which extends downward from the first cylindrical section 9*b*-1*b* and has a sloped inner wall, a second cylindrical section 9*b*-1*d* which extends downward from the conical section 9*b*-1*c* and has the smallest diameter and a third cylindrical section 59 which is positioned just below the second cylindrical section 9*b*-1*b* and has a size to receive an upper end of the cylindrical metal case 7. As is seen from the drawing, when the upper end of the metal case 7 is put into the third cylindrical section 59, a cylindrical inner surface 7*a* of the metal case 7 is flush with an inner surface of the second cylindrical section 9*b*-1*d*. However, if desired, the diameter of the second cylindrical section 9*b*-1*d* may be slightly smaller than the inner diameter of the metal case 7.

In this guide member 9-1, due to provision of the first cylindrical section 9*b*-1*b* which has a diameter equal to or slightly larger than the diameter of the coiled body 5, the coiled body 5 can be stably held in the bore 9*a*-1 before being pressed by the pressing member 15, which induces a straight or accurate downward movement of the coiled body 5 when the body 5 is actually pressed by the pressing member 15. Thus, insertion of the coiled body 5 into the metal case 7 is much smoothed.

Figure 6:
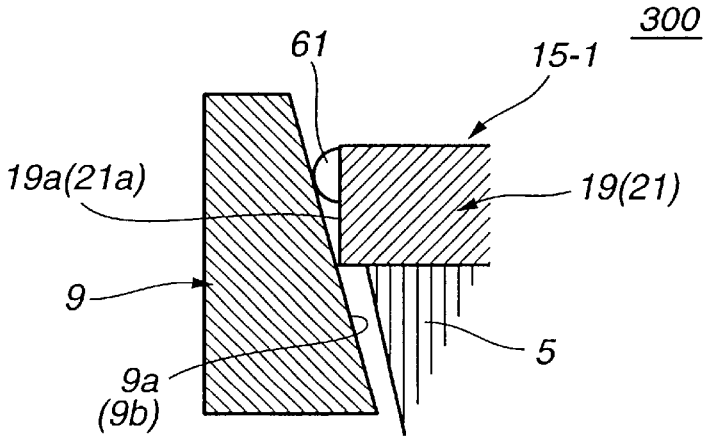
FIGS. 6 and 7 are sectional views of an essential portion of a fitting device which is a third embodiment of the invention.
Figure 7:
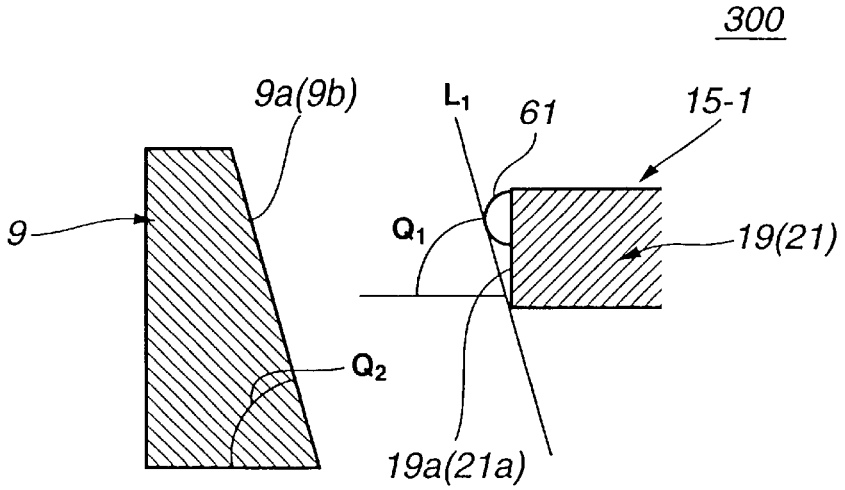

Referring to FIGS. 6 and 7, there is shown, but partially, a fitting device 300 of a third embodiment of the present invention. In this third embodiment, the guide member is the same as the guide member 9 used in the first embodiment 100.

As is seen from FIG. 6, the pressing member 15-1 used in this third embodiment 300 employs a plurality of guide projections 61 in place of the circular guide plate 55 employed in the first embodiment 100. By using such guide projections 61, smoothed radial movement of the two side plates 19 and 21 is achieved.

That is, as is seen from FIGS. 6 and 7, the guide projections 61 are hemispherical guide projections secured to rounded outer walls 19*a* and 21*a* of the side plates 19 and 21 at certain intervals. Because of difference in shape between the circular cross section of the conical bore 9*a* of the guide member 9 and the elliptic shape of the pressing member 15-1, the guide projections 61 have different sizes. That is, the guide projections 61 arranged on an extension of the axis of the stay bolt 33 (see FIG. 1) are the smallest, and the guide projections 61 increase their size as the distance from the extension of the axis increases.

The guide projections 61 located near the extension of the axis of the stay bolt 33 have the following arrangement which will be described with the aid of FIG. 7.

That is, as is seen from FIG. 7, each of the guide projections 61 is so arranged as to satisfy that an inclination angle "θ1" of an imaginary line "L1" which contacts both the guide projection 61 and the lower edge of the rounded outer wall is equal to an inclination angle "θ2" of the sloped inner wall 9*b* of the conical bore 9*a*.

As is seen from FIG. 6, during the downward movement of the pressing member 15 in the conical bore 9*a* of the guide member 9, the guide projections 61 function to prevent undesired inclination of the two side plates 19 and 21.

Figure 8:
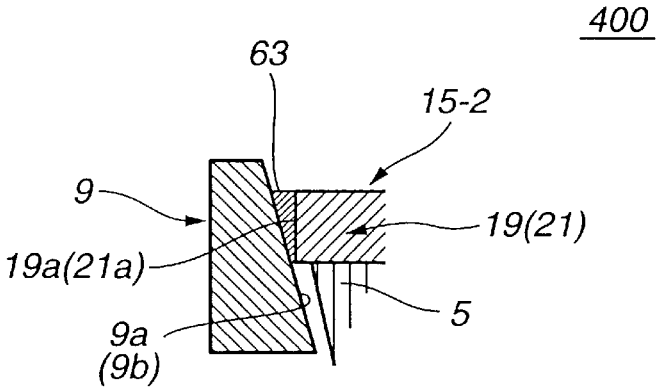
FIG. 8 is a view similar to FIG. 6, but showing a fourth embodiment of the present invention.

Referring to FIG. 8, there is shown, but partially, a fitting device 400 of a fourth embodiment of the present invention. Also in this fourth embodiment, the guide member is the same as the guide member 9 used in the first embodiment 100.

In the pressing member 15-2 used in this fourth embodiment 400, guide projections 63 secured to the rounded side walls 19*a* and 21*a* of the side plates 19 and 21 have each a triangular cross section. That is, each guide projection 63 has a convex outer surface which is slidably engageable with the sloped or conical inner surface 9*b* of the bore 9*a* of the guide member 9.

Figure 9:
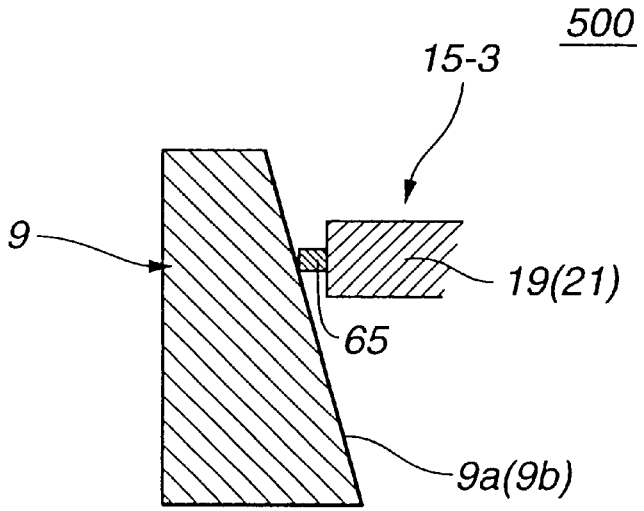
FIG. 9 is a view similar to FIG. 6, but showing a fifth embodiment of the present invention.

Referring to FIG. 9, there is shown, but partially, a fitting device 500 of a fifth embodiment of the present invention.

In the pressing member 15-3 used in this embodiment, plate type members 65 are employed in place of the above-mentioned guide projections 61 and 63.

Figure 10:
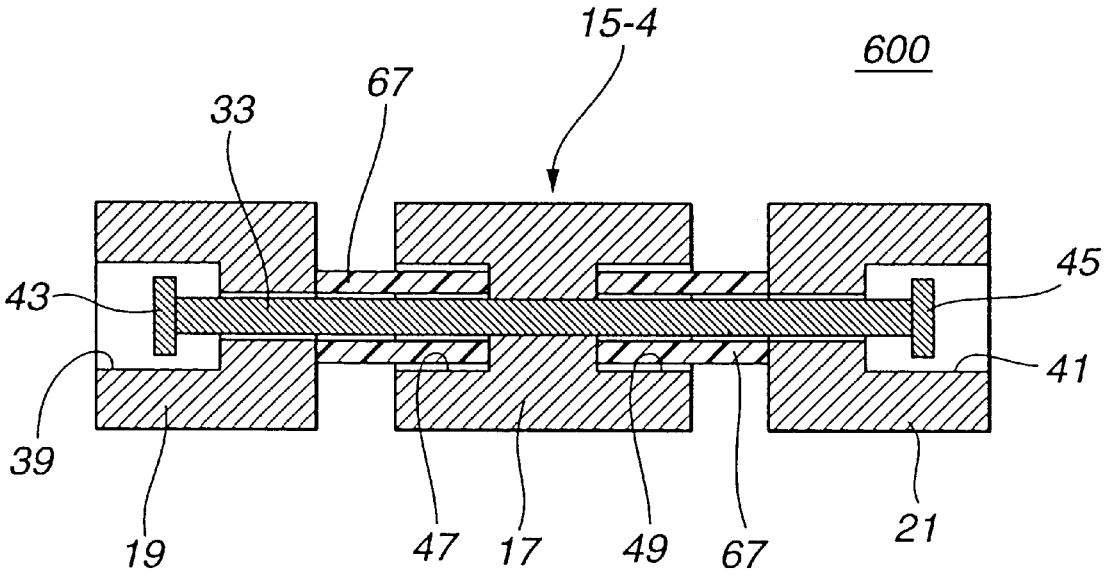
FIG. 10 is a sectional view of a pressing member used in a fitting device of sixth embodiment of the present invention.

Referring to FIG. 10, there is shown a pressing member 15-4 used in a fitting device 600 of a sixth embodiment of the present invention.

The pressing member 15-4 is substantially the same as the above-mentioned pressing member 15 (see FIG. 2) used in the first embodiment 100 except that in the sixth embodiment, two elastic rubber tubes 67 are used in place of the coil springs 51 and 53. In FIG. 10, members corresponding to the circular guide plate 55, the mounting rod 27, etc., (see FIG. 2) employed in the pressing member 15 are not shown.

Figure 11:
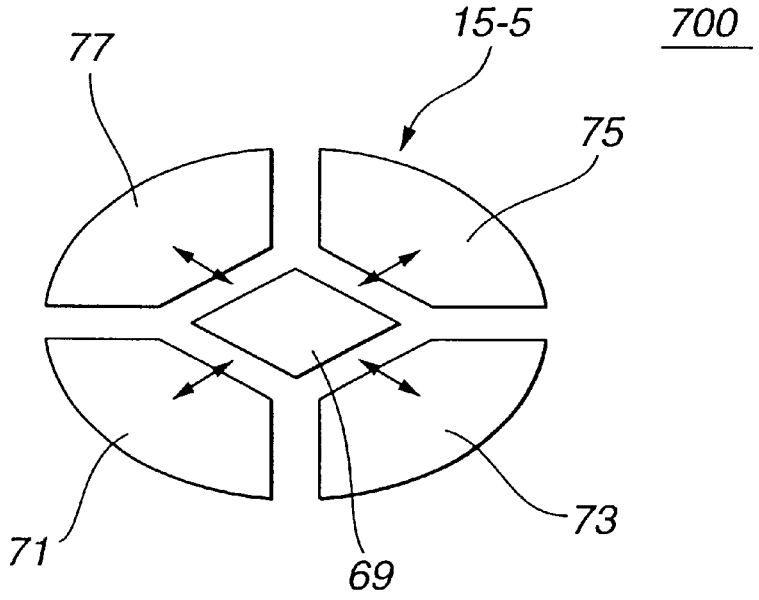
FIGS. 11 and 12 are plan views of pressing members used in fitting devices of seventh and eighth embodiments of the present invention.

Referring to FIG. 11, there is schematically shown a pressing member 15-5 used in a fitting device 700 of a seventh embodiment of the present invention.

The fitting device 700 of this embodiment is designed for handling a coiled body having an elliptical cross section. Thus, a guide member used in this seventh embodiment 700 is of a type which is formed with an elliptic cylindrical bore whose sectional area gradually reduces from the top to the bottom.

As is seen from FIG. 11, the pressing member 15-5 used in this seventh embodiment 700 comprises generally a rhombic center base plate 69 which is connected to a piston rod (23) of a hydraulic cylinder, four sectorial outer plates 71, 73, 75 and 77 which surrounds the center base plate 69 and are movable radially, two mutually angled stay bolts which pass through the center base plate and movably hold the outer plates 71, 73, 75 and 77, four spring members which bias the four outer plates 71, 73, 75 and 77 radially outward and an elliptical guide plate which is secured to the center base plate 69 to smoothly guide the radial movement of the outer plates 71, 73, 75 and 77.

Figure 12:
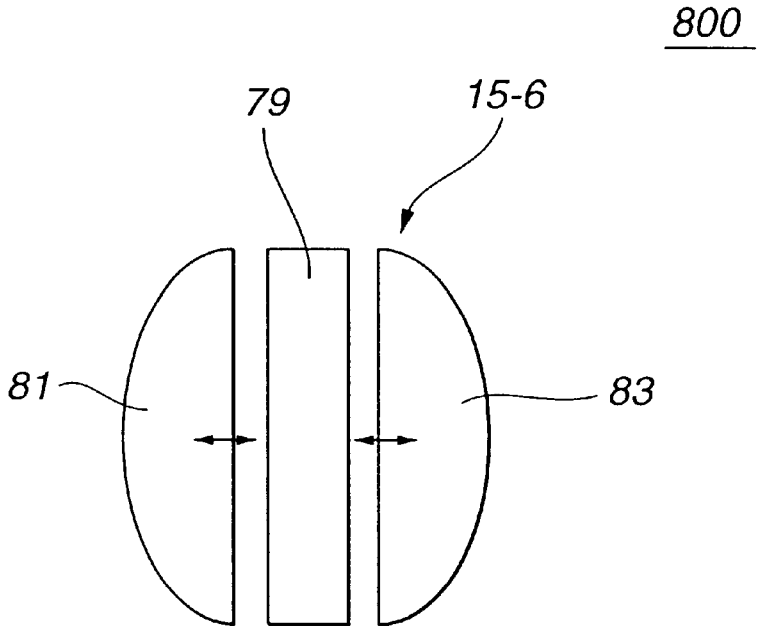
Figure 13:
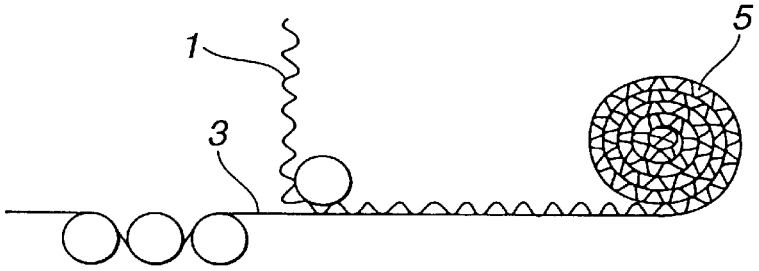
FIG. 13 is a schematic view showing a known method of producing a coiled body, that is, a coiled catalyst bed.

Referring to FIG. 12, there is schematically shown a pressing member 15-6 used in a fitting device 800 of an eighth embodiment of the present invention.

The fitting device 800 of this embodiment is designed also for handling a coiled body having an elliptical cross section. Thus, a guide member used in this embodiment has an elliptic cylindrical bore whose sectional area gradually reduces from the top to the bottom.

As is seen from FIG. 12, the pressing member 15-6 used in this eighth embodiment 800 comprises generally a rectangular center base plate 79 which is connected to a piston rod (23) of a piston rod of a hydraulic cylinder, two crescent-shaped side plates 81 and 83 which are arranged at opposite sides of the center base plate 79 and movable radially, a stay bolt which passes through the center base plate and movably holds the side plates 81 and 83, two spring members which bias the side plates 81 and 83 radially outward and an elliptical guide plate which is secured to the center base plate 79 to smoothly guide the radial movement of the side plates 81 and 83.

The entire contents of Japanese Patent Application 2000-164439 (filed Jun. 1, 2000) are incorporated herein by reference.

Although the invention has been described above with reference to the embodiments of the invention, the invention is not limited to such embodiments as described above. Various modification and variations of such embodiment may be carried out by those skilled in the art, in light of the above description.

What is claimed is:

1. A device for press-fitting a generally cylindrical body into a cylindrical case, said generally cylindrical body being subjected to reduction in diameter when applied with a certain external force from a radial direction, comprising:

a guide member formed with a vertically extending bore of which cross section gradually reduces in size with increase of a distance from a top of the bore toward a bottom of the same, the cross section of the bottom of said bore being slightly smaller than that of said generally cylindrical body, said guide member being adapted to be put on said cylindrical case having the bore of the guide member coaxially aligned with the interior of said cylindrical case;

a pressing member which, when actuated, presses down said generally cylindrical body raised in the bore of said guide member thereby to thrust the raised generally cylindrical body into said cylindrical case through said bottom of the bore; and an actuator for actuating said pressing member, wherein said pressing member includes a center base plate, at least two side plates positioned on both sides of said center base plate, a guide structure by which said side plates are radially movable in opposite directions with respect to said center base plate, and biasing members for biasing said side plates radially outward.

2. A device as claimed in claim 1, in which said pressing member is so sized and constructed as to keep said side plates in contact with a sloped inner wall of said bore of the guide member while the pressing member is axially moved in said bore of the guide member.

3. A device as claimed in claim 2, in which said guide structure of said pressing member comprises:

a stay bolt passing through said center base plate and loosely holding said side plates at its axially opposed exposed portions; and stoppers secured to axially opposed ends of said stay bolt to prevent excessive outward movement of said side plates.

4. A device as claimed in claim 3, in which said guide structure further comprises a guide plate which is secured to said center base plate, said guide plate having a flat lower surface with which upper flat surface of said side plates is slidably engaged.

5. A device as claimed in claim 3, in which said guide structure comprises a plurality of guide projections which are secured to rounded outer walls of said side plates at given intervals.

6. A device as claimed in claim 5, in which each of said guide projections is so arranged as to satisfy that an inclination angle of an imaginary line which contacts both the guide projection and a lower edge of the rounded outer wall is equal to an inclination angle of a sloped inner wall of said bore of said guide member.

7. A device as claimed in claim 5, in which each of said projections is so shaped as to have one of a semicircular cross section, a triangular cross section and a rectangular cross section.

8. A device as claimed in claim 1, in which said center base plate is circular in shape and said side plates are arcuate in shape, each of said side plates having in an inside part thereof a concave recess whose perimeter is substantially the same as that of a half of the circular center base plate.

9. A device as claimed in claim 1, in which said biasing members are one of coil springs and elastic rubber tubes.

10. A device as claimed in claim 1, in which said actuator comprises:

a hydraulic cylinder; and a piston rod extending from said hydraulic cylinder, said piston rod being connected to said center base plate to move therewith.

11. A device as claimed in claim 1, in which said bore of the guide member is conical in shape.

12. A device as claimed in claim 1, in which said bore of the guide member comprises:

a tapered upper section having the largest diameter;

a first cylindrical section extending downward from said tapered upper section and having a diameter equal to or greater than the diameter of the cylindrical coiled body;

a conical section extending downward from said first cylindrical section and having a sloped inner wall;

a second cylindrical section extending downward from said conical section and having the smallest diameter; and a third cylindrical section positioned just below said second cylindrical section and having a size to receive an upper end of the cylindrical case.

13. A device as claimed in claim 1, in which said pressing member further comprises additional two side plates positioned on both sides of said center base plate, an additional guide structure by which said additional side plates are radially movable in opposite directions with respect to said center base plate; and additional biasing members for biasing said additional side plates radially outward.

14. A device for press-fitting a cylindrical coiled body into a cylindrical case, comprising:

a guide member formed with a conical bore of which cross section gradually reduces in size with increase of a distance from a top of the bore toward a bottom of the same, the cross section of the bottom of said bore being slightly smaller than that of said coiled body, said guide member being adapted to be put on said cylindrical case having the bore of the guide member coaxially aligned with the interior of said cylindrical case;

a pressing member which, when actuated, presses down said cylindrical coiled body raised in the bore of said guide member thereby to thrust the raised coiled body into said cylindrical case through said bottom of the bore; and an actuator for actuating said pressing member, wherein said pressing member includes:

a circular center base plate;

two arcuate side plates positioned at both sides of said center base plate having concave sides thereof directed toward said base plate;

a stay bolt held by said center base plate and having axially opposed end portions projected from said center base plate in opposite directions, said axially opposed end portions movably carrying said arcuate side plates; and two spring members each being compressed between said center base plate and corresponding one of said arcuate side plates to bias the arcuate side plate outward.

* * * * *